United States Patent [19]

Kiba et al.

[11] 4,429,984

[45] Feb. 7, 1984

[54] COPYING MACHINE WITH TRACTION FEED

[75] Inventors: Akira Kiba, Toyokawa; Kazuo Sugimoto, Moriyama, both of Japan

[73] Assignee: Minolta Camera Kabushiki Kaisha, Osaka, Japan

[21] Appl. No.: 357,315

[22] Filed: Mar. 11, 1982

[30] Foreign Application Priority Data

Mar. 18, 1981 [JP] Japan ..... 56-38833[U]

[51] Int. Cl.[3] ..... G03G 15/14; G03G 21/00

[52] U.S. Cl. ..... 355/3 SH; 83/103; 83/167; 355/3 TR

[58] Field of Search ..... 355/3 R, 3 SH, 3 TR; 226/53; 83/103, 167

[56] References Cited

U.S. PATENT DOCUMENTS

| | | | |
|---|---|---|---|
| 3,679,300 | 7/1972 | Artelt | 355/3 R |
| 3,977,780 | 8/1976 | Cassano et al. | 355/3 R |
| 4,010,882 | 3/1977 | Turner | 355/3 SH X |
| 4,086,007 | 4/1978 | Smith et al. | 355/3 SH |
| 4,125,322 | 11/1978 | Kaukeinen et al. | 355/4 |
| 4,312,253 | 1/1982 | Johnson et al. | 83/167 |

*Primary Examiner*—Fred L. Braun

*Attorney, Agent, or Firm*—Wenderoth, Lind & Ponack

[57] ABSTRACT

A copying or similar type machine of the traction feed type having a traction device for transporting a continuous sheet of paper perforated along the edges to a processor past a portion of an image forming device so as to pass the sheet over a portion of the image forming device. The traction device has an endless belt having projections at opposite edges thereof engageable with the perforations of the sheet, the traction device being shiftably mounted for movement between an operative position close to the image forming assembly and an inoperative position spaced from the operative position, and a plate-like member is positioned along and immediately below the traction device when the traction device is in its operative position for receiving particles of paper released from the traction device to prevent the particles from getting into other components and is movable to a position between the traction device and the image forming device when the traction device is shifted to its inoperative position for holding the leading edge of the sheet for initial setting of the sheet on the traction device and also for protecting the image forming device.

8 Claims, 5 Drawing Figures

COPYING MACHINE WITH TRACTION FEED

The present invention relates to copying or similar type machines of the so-called traction feed type, and more particularly to such a machine in which a continuous sheet of paper having perforations at the opposite edges is transported by a traction device having projections engaging the perforations.

BACKGROUND OF THE INVENTION AND PRIOR ART

A continuous sheet of paper, such as printout paper for computers, is usually provided with perforations at its opposite edges and is transported by a traction device having projections engageable in the perforations. This method of transport, which is called "traction feed", has the advantage that the continuous sheet can be transported smoothly without zigzagging.

In copying machines of this type, images are formed on a continuous sheet of paper which is being fed by the traction device. Such images are formed, for example, by an electrophotographic process. The electrophotographic process comprises the steps of forming a latent electrostatic image on a photosensitive member, developing the latent image with toner to obtain a toner image and transferring the toner image onto the paper.

The traction feed method, nevertheless, has the problem that the paper releases particles of paper at the traction device because the paper is perforated. These particles get into some of the other units and impair the performance thereof, possibly resulting in a malfunction of the units.

The conventional traction feed method has another drawback in that the continuous sheet of paper must be set in place by a very cumbersome procedure, i.e. by passing the sheet around the traction device and properly engaging the projections of the device in the perforations of the sheet. To eliminate the above drawback, it is possible to make the traction device substantially completely retractable from the image forming zone, but this requires a large space which makes the overall size of the machine large.

Accordingly it would be desirable to have a traction device which occupies only a small space and onto which the continuous sheet can be set easily. However, since the sheet must be set onto the device in the vicinity of the image forming zone, care must be taken to avoid possible damage to the image forming assembly, e.g. the photosensitive member, that could result when a tool or the like strikes against the assembly

OBJECTS AND BRIEF SUMMARY OF THE INVENTION

The main object of the present invention is to provide a traction feed type copying or similar type machine which is free of the foregoing drawbacks.

Another object of the invention is to provide a traction feed type copying or similar type machine which is reliable, compact and easy to operate.

Another object of the invention is to provide a traction feed type copying or similar type machine including a simple arrangement for preventing particles of paper from getting into the other components, facilitating the setting into place of a continuous sheet of paper and protecting the image forming assembly.

These and other objects of the invention are fulfilled by providing a traction device shiftably mounted for movement between an operative position close to an image forming assembly and in an operative position, and a member for performing the function of preventing particles of paper from getting into other components when the traction device is in its operative position and serving the function of guiding a continuous sheet of paper for the setting of the sheet and also the function of protecting the image forming assembly when the traction device is in its inoperative position.

More specifically the invention provides a copying or similar type machine of the traction feed type comprising a traction device shiftably mounted for movement between an operative position close to an image forming assembly for transporting a perforated continuous sheet of paper through the image forming assembly and an inoperative position spaced from the operative position, and a plate-like member positioned below and adjacent the traction device when the traction device is in its operative position and located between the traction device and the image forming assembly when the traction device is in its inoperative position, the plate-like member performing the function of receiving the particles of paper released from the traction device to prevent the particles from getting into other components when the traction device is in its operative position and serving the function of guiding the sheet for the setting of the sheet and also the function of protecting the image forming assembly when the traction device is in its inoperative position.

These and other objects, advantages and features of the invention will become apparent from the following description thereof taken in conjunction with the accompanying drawings which illustrate a specific embodiment of the invention.

BRIEF DESCRIPTION OF THE DRAWINGS

In the following description, like parts are designated by like reference numbers throughout the several drawings.

DETAILED DESCRIPTION OF THE INVENTION

Figure 1:
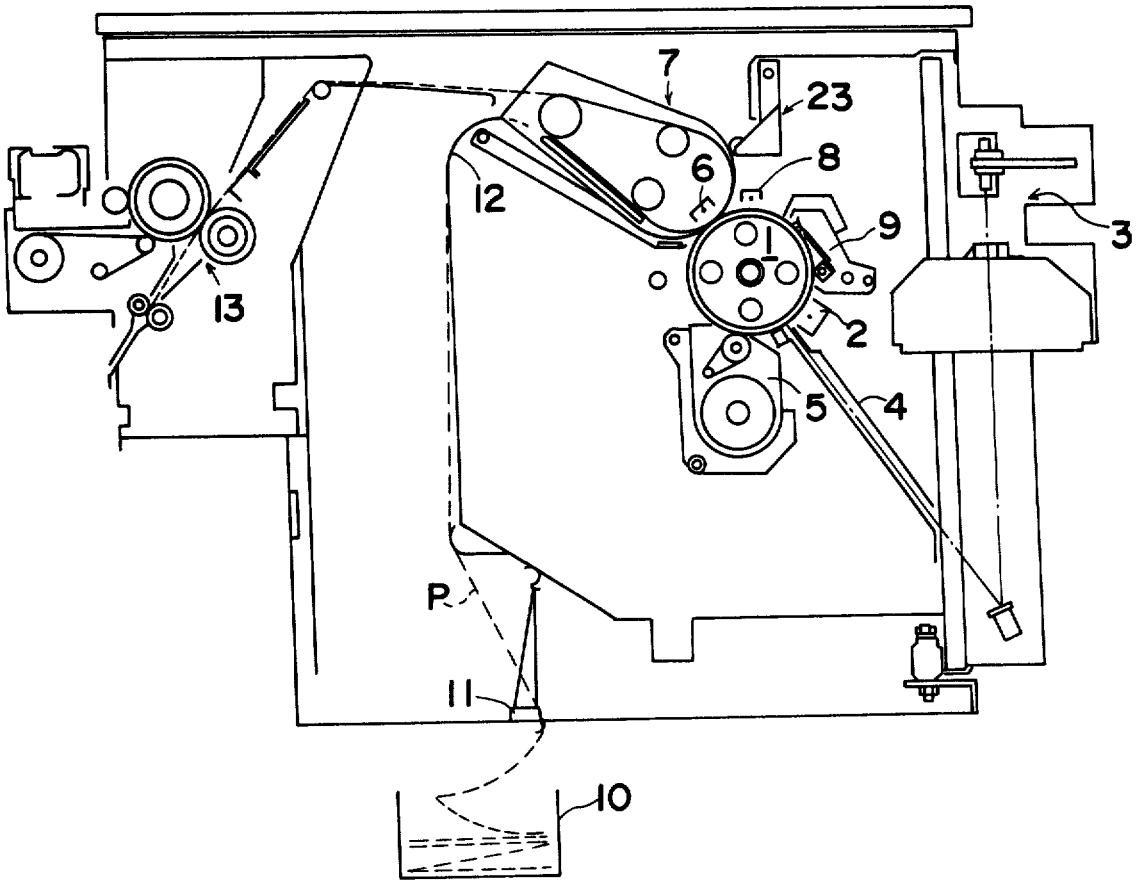
FIG. 1 is a sectional view schematically showing a copying machine of the traction feed type.

As shown in FIG. 1, the copying machine has a photosensitive drum 1 which is rotatable clockwise and disposed approximately in the center of the right side portion of the main body of the machine. Arranged around the drum 1 are positioned a sensitizing charger 2, a path 4 for a laser beam from a laser unit 3, a developing unit 5, a traction device 7 including a transfer charger 6, an erasing charger 8 and a cleaner 9.

A continuous sheet of paper P, stored in a storage means 10 is passed over a guide member 11 and a guide plate 12 into the traction device 7, is further passed between the photosensitive drum 1 and the transfer charger 6 and then guided into a fixing unit 13, from which the sheet is delivered onto an unillustrated tray.

The principle of forming images by the copying machine is known and will therefore be described only briefly. The drum 1 is first uniformly charged by the sensitizing charger 2, and a laser beam from the laser unit 3 and which has been modulated by the image of an original, for example in a manner similar to that disclosed in U.S. Pat. No. 4,125,322, is projected onto the surface of the drum 1 to form thereon a latent electrostatic image in conformity with the image of the original. The latent image is developed by the developing unit 5 to a toner image, which is transferred by the transfer charger 6 onto the continuous sheet P fed by the traction device 7. Thus an image is formed on the sheet P by the transfer of the toner image. The charges remaining on the surface of the drum 1 after the transfer are removed by the erasing charger 8, and the toner remaining on the surface is also removed by the cleaner 9. The drum surface is then used for the next cycle. The sheet P having the toner image transferred thereto is passed through the fixing unit 13 to fix the toner image and is then discharged onto the tray.

The sheet P extends continuously from the storage means 10 to the tray and has perforations along each edge and is transported by the traction device 7 past a portion of the image forming means, i.e. the photosensitive drum 1, so as to press the sheet over a portion of the photosensitive drum 1, and then to the fixing unit 13.

Figure 2:
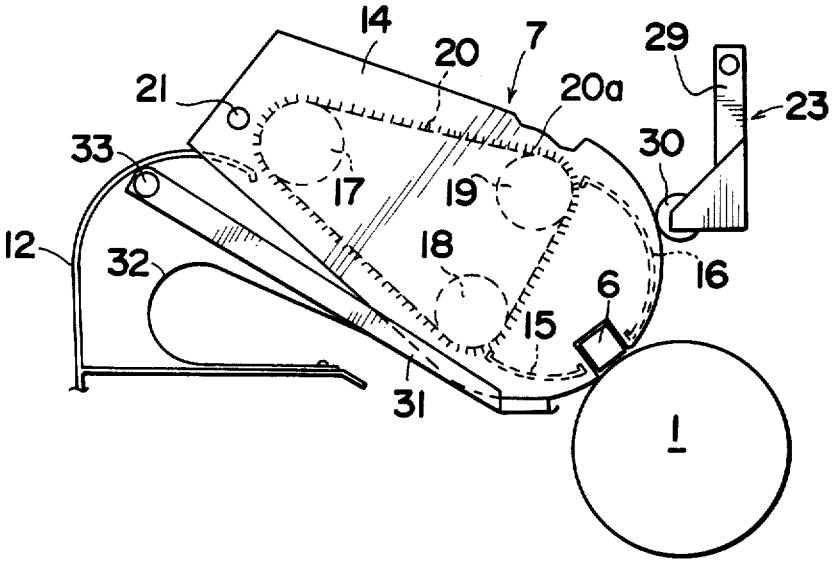
FIG. 2 is a fragmentary side elevation showing an arrangement of the invention with the traction device in its operative position.

As seen in FIG. 2, the traction device 7 has, between side plates 14, a paper transport portion, paper guide members 15 and 16 and the transfer charger 6. The paper transport portion comprises three rollers 17, 18 and 19 and an endless belt 20 reeved around these three rollers and having on its opposite edges projections 20*a* engagable in the perforations in the sheet P.

Figure 3:
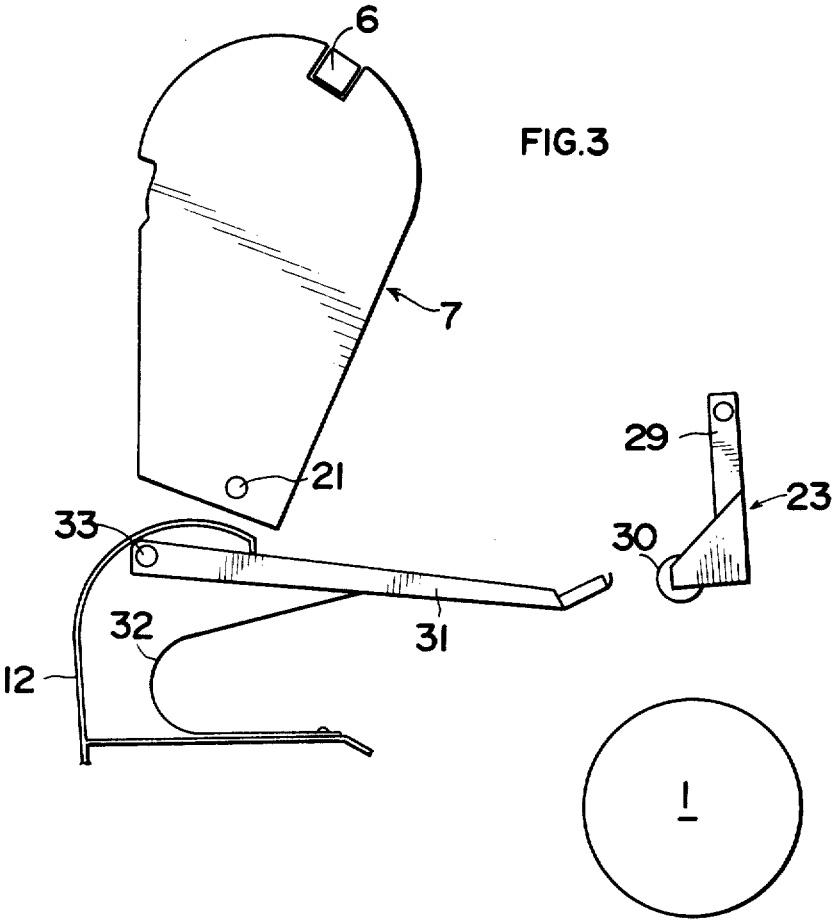
FIG. 3 is a fragmentary side elevation showing the arrangement with the traction device in its inoperative position.

The traction device 7 is supported on a pivot 21 and pivotally movable between an operative position shown in FIG. 2 and an inoperative position shown in FIG. 3.

Arranged around the traction device 7 are holding means 22 (see FIG. 4) for holding the traction device 7 in its operative position, guide means 23 for setting the traction device 7 in its operative position and a plate-like member 31.

Figure 4:
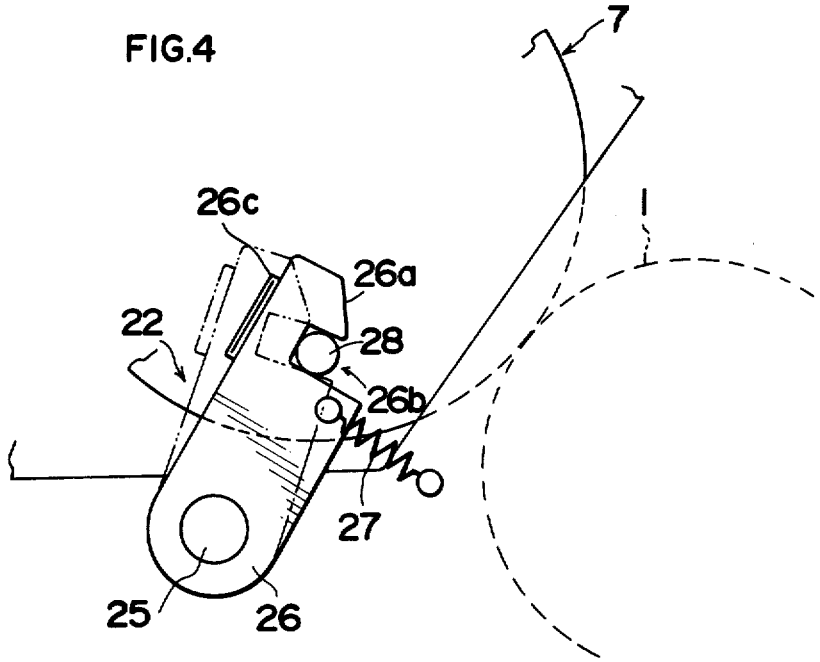
FIG. 4 is a fragmentary side elevation showing the arrangement in which the traction device is held in its operative position.

As shown in FIG. 4, the holding means 22 comprises an engaging member 26 pivotably supported on a pivot 25 on the main body of the machine and a spring 27 biasing the engaging member 26 clockwise in the figure. The engaging member 26 has a slanting cam surface 26*a*, a cutout portion 26*b* at the lower end of the cam surface and engageable with a pin 28 on the traction device 7, and a disengaging lug 26*c* projecting laterally of engaging member 26.

The guide means 23 comprises a pivotally mounted support bar 29 movable and biased clockwise and a roller 30 mounted on the free end of the support bar 29 and adapted to contact the side plate 14 of the traction device 7.

The plate-like member 31 is positioned under the traction device 7, and extends from a location near the terminal end of the guide plate 12 toward the photosensitive drum 1. A plate spring member 32 for biasing the plate-like member 31 toward the traction device 7 is provided beneath the member 31. The plate-like member 31 is pivotally mounted on a pivot 33.

Figure 5:
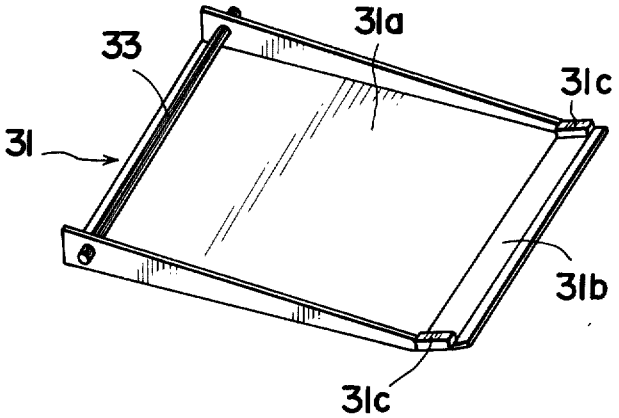
FIG. 5 is a perspective view showing a plate-like member forming part of the present invention.

As shown in FIG. 5, the plate-like member 31 comprises a paper particle receptacle portion 31*a* having upstanding edge plates at its opposite sides, a confining portion 31*b* at the free end and bent upward for preventing the escape of paper particles, and abutting portions 31*c* provided at the opposite sides of the confining portion 31*b* and adapted to contact the side plates 14 of the traction device 7.

To shift the traction device 7 from the operative position of FIG. 2 to the inoperative position of FIG. 3, the engaging member 26 is first turned counterclockwise by the disengaging lug 26*c* of the member 26, disengaging the cutout portion 26*b* from the pin 28, whereupon the traction device 7 is shifted slightly upward by the plate spring member 32. The traction device 7 is then manually turned to the position of FIG. 3. The traction device 7 may be made turnable automatically by biasing the device 7 toward the inoperative position.

Conversely, to set the traction device 7 in the operative position from the inoperative position, the traction device 7 is turned clockwise by hand. At this time, the roller 30 on the guide means 23 comes into contact with the side plate 14 to guide the device. When the traction device 7 reaches a location close to the operative position, the pin 28 thereon comes into contact with the slanting cam surface 26*a* on the engaging member 26 and turns the engaging member 26 counterclockwise against the action of spring 27. When the traction device 7 is further depressed, the pin 28 engages in the cutout portion 26*b*, by the action of spring 27, whereby the traction device 7 is held in its operative position.

While the traction device 7 is in its operative position in the above arrangement, the plate-like member 31 is located just below and adjacent the device, being inclined downwardly toward the drum 1, and acts to catch the particles of paper released from the traction device 7. The particles collected in the receptacle portion 31*a* are removed, for example, when the machine is inspected periodically by the serviceman.

While the traction device 7 is in its inoperative position, the plate-like member 31 is raised to a less inclined position between the drum and the device 7 by the plate spring member 32 to serve as a shutter for protecting the photosensitive drum 1. Even if while the traction device 7 is in the inoperative position a tool or the like being used for setting the continuous sheet of paper or for inspection should be dropped, the photosensitive drum 1 is protected by the plate-like member 31 against being damaged. Moreover, the collected particles of paper will not be spilled.

Further, when the leading end of the continuous sheet P to be set onto the traction device 7 is inserted into the space between the guide plate 12 and the device 7, the leading end will be guided by the plate-like member 31 to a location accessible to the user. The present arrangement therefore greatly facilitates the setting of the continuous sheet.

As already described, the plate-like member 31 performs the function of receiving particles of paper so as to prevent the particles from getting into other components, the function of protecting the photosensitive drum 1, i.e. the image forming means, and the function of guiding the continuous sheet of paper to be set in place.

The foregoing embodiment, although adapted to merely receive paper particles, can further be provided with an aspirator for removing the particles from the plate-like member 31 by suction.

It is also possible to provide a member for sealing the space between the plate-like member 31 and the traction device 7 to prevent the escape of paper particles more effectively.

The embodiment described may be modified suitably in accordance with the amount of paper particles to be produced depending on the copying speed, operating time, etc.

Although the present invention has been fully described by way of example with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A copying or similar type machine of the traction feed type comprising a traction device for transporting a continuous sheet of paper perforated along the edges from a storage means to a processing means past a portion of an image forming means so as to pass the sheet over a portion of the image forming means, said traction device having an endless belt having projections at opposite edges thereof engageable with the perforations of the sheet, said traction device being shiftably mounted for movement between an operative position close to the image forming assembly and an inoperative position spaced from the operative position; and a plate-like member positioned along and immediately below said traction device when said traction device is in its operative position for receiving particles of paper released from said traction device to prevent the particles from getting into other components and movable to a position between said traction device and the image forming means when the traction device is shifted to its inoperative position for holding the leading edge of the sheet for initial setting of the sheet on the traction device and also for protecting the image forming means.

2. A copying or similar type machine as claimed in claim 1, wherein said plate-like member is pivotally supported for the movement from the position beneath the traction device to the position between the traction device and the image forming means.

3. A copying or similar type machine as claimed in claim 2, wherein said plate-like member has a paper particle receptacle portion, an abutting portion at the free end thereof for contacting said traction device, and said machine further comprises a spring member for biasing said plate-like member toward the position between said traction device when it is in its inoperative position and the image forming means.

4. A copying or similar type machine as claimed in claim 3, wherein said traction device is pivotally supported at the same end as said plate-like member and said machine further comprises an engaging member for maintaining said traction device in its operative position against the force of said spring member.

5. A copying machine comprising a photosensitive member on which a toner image is formed, a traction device for transporting a continuous sheet of paper having perforated edges from a storage means to a fixing station through an image transfer region between said traction device and said photosensitive member, said traction device having an endless belt with projections at the opposite edges thereof engageable with the perforations of the sheet, and a transfer member therein for transferring the toner image from the photosensitive member to the transporting sheet, said traction device being shiftably mounted for movement between an operative position close to the photosensitive member and an inoperative position spaced from the operative position; and a plate-like member positioned along and immediately below said traction device when said traction device is in its operative position for receiving particles of paper released from said traction device to prevent the particles from getting into other components and movable to a position between said traction device and the photosensitive member when the traction device is shifted to its inoperative position for holding the leading edge of the sheet for initial setting of the sheet on the traction device and also for protecting the photosensitive member.

6. A copying machine as claimed in claim 5, wherein said plate-like member has a paper particle receptacle portion, an abutting portion at the free end thereof for contacting said traction device, and said machine further comprises a spring member for biasing said plate-like member toward the position between said traction device when it is in its inoperative position and the photosensitive member.

7. A copying machine as claimed in claim 6, wherein said traction device is pivotally supported at the same end as said plate-like member and said machine further comprises an engaging member for maintaining said traction device in its operative position against the force of said spring member.

8. A copying machine as claimed in claim 5 in which said plate-like member is inclined downwardly toward said photosensitive member when the traction device is in its operative position, and said plate-like member is movable upwardly to a less inclined position when the traction device is shifted to its inoperative position.

* * * * *